US006460791B1

(12) United States Patent
Stehr

(10) Patent No.: US 6,460,791 B1
(45) Date of Patent: Oct. 8, 2002

(54) AGITATOR MILL

(75) Inventor: Norbert Stehr, Grünstadt (DE)

(73) Assignee: Draiswerke GmbH, Mannheim (DE)

( * ) Notice: Subject to any disclaimer, the term of this patent is extended or adjusted under 35 U.S.C. 154(b) by 6 days.

(21) Appl. No.: 09/801,663

(22) Filed: Mar. 9, 2001

(30) Foreign Application Priority Data

Mar. 9, 2000 (DE) ..... 100 11 579

(51) Int. Cl.[7] ..... B02C 17/16
(52) U.S. Cl. ..... 241/171; 241/172; 241/184
(58) Field of Search ..... 241/171, 172, 241/184

(56) References Cited

U.S. PATENT DOCUMENTS 4,848,676 A 7/1989 Stehr

FOREIGN PATENT DOCUMENTS

DE 1214516 B1 4/1966
DE 12 33 237 C1 8/1967
DE 28 45 084 A1 4/1980
DE 32 45 825 A1 6/1984

*Primary Examiner*—Mark Rosenbaum
(74) *Attorney, Agent, or Firm*—Browdy and Neimark, P.L.L.C.

(57) ABSTRACT

An agitator mill with a grinding receptacle comprises a grinding chamber defined by an inner wall thereof and a rotor which is located therein and driven in high-speed actuation. Mounted on the rotor are agitator elements which stand out radially and to which are allocated counterpart elements mounted on the inner wall. A grinding-stock inlet is provided on an end of the grinding chamber and a grinding-stock outlet is provided on the other end of the grinding chamber, comprising an auxiliary-grinding-body separating device for the auxiliary grinding bodies in the grinding chamber to be held back. The distance of agitator elements and counterpart elements which adjoin each other decreases from the grinding-stock inlet towards the auxiliary-grinding-body separating device.

16 Claims, 2 Drawing Sheets

AGITATOR MILL

BACKGROUND OF THE INVENTION

1. Field of the Invention

The invention relates to an agitator mill comprising a grinding receptacle, which has a cylindrical wall, a bottom, and a cover; a grinding chamber formed in the grinding receptacle; an agitator unit, which has a driving shaft, which is disposed substantially outside the grinding chamber and driven in rotation, and a rotor, which is located in the grinding chamber and connected to the driving shaft; agitator elements mounted on the rotor, which are disposed in radial planes radially of the central longitudinal axis, and which project into the grinding chamber radially of the central longitudinal axis towards the wall of the grinding receptacle; counterpart elements mounted on the wall of the grinding receptacle, which are disposed in radial planes radially of the central longitudinal axis, and which project towards the rotor into the grinding chamber; a grinding-stock inlet, which leads through the bottom into the grinding chamber; an auxiliary-grinding-body separating device disposed in the vicinity of the cover and which is disposed upstream of a grinding-stock outlet; and a filling of auxiliary grinding bodies, with a diameter a, in the grinding chamber.

2. Background Art

Agitator mills of the generic type pose the fundamental problem that the auxiliary grinding bodies are entrained in the grinding-stock flow direction and accumulate in front of the separating device, which may lead to impairment of the grinding and dispersing process and, in the extreme, to the agitator mill being blocked.

For avoidance of the mentioned effect, U.S. Pat. No. 4,848,676 teaches, in the case of an agitator mill of the generic type, to provide a device for detection of the distribution of the auxiliary grinding bodies in the grinding chamber, which comprises a measuring point for detection of the pressure drop in the grinding chamber as compared to atmospheric, this measuring point sensing the grinding-stock pressure directly before the grinding chamber, with transgression of a given pressure drop constituting a measure for a concentration of auxiliary grinding bodies at the grinding-stock inlet and in front of the separating device, respectively. Furthermore, a device is provided for the regular distribution of the auxiliary grinding bodies in the grinding chamber, the effect of which resides in a reduction of the mass flow when the auxiliary grinding bodies concentrate in front of the separating device. This design has proved very successful, but it requires some implementation in terms of measuring and regulation.

DE 32 45 825 A1 teaches to provide a device in an agitator mill, which selectively exercises, at least substantially only on the auxiliary grinding bodies, a force in the opposite direction of the flow of grinding stock. This is to prevent the auxiliary grinding bodies from migrating before the separating device. For detection of auxiliary grinding bodies that arrive before the separating device, a pressure sensor is provided, by means of which the pressure of the auxiliary grinding bodies is sensed in this area.

SUMMARY OF THE INVENTION

It is an object of the invention to embody an agitator mill of the generic type in such a way that accumulation of the auxiliary grinding bodies before the separating device is at least largely precluded by simple means.

According to the invention, this object is attained by the features which consist in that the distance from each other of agitator elements and adjacent counterpart elements in the direction of the central longitudinal axis decreases from a greatest distance c in the vicinity of the grinding-stock inlet to a smallest distance b in the vicinity of the auxiliary-grinding-body separating device. Reducing the distance of agitator elements from neighboring counterpart elements towards the separating device helps obtain a higher local shear intensity and thus an increased power density as the distance decreases. As the auxiliary grinding bodies tend to avoid the status of increased power density, they migrate to the area of lower power density, i.e. to the area where the agitator elements have greater distances from the neighboring counterpart elements. This effect is of special importance when a very tough i.e., very viscous, grinding stock is ground. The grinding i.e., the comminution, of the grinding stock particles, increases the surface thereof—related to their mass. This increases the toughness of the grinding stock in the flow direction. The growing toughness leads to increasingly higher entrainment forces in the flow direction which would give rise to an accumulation of auxiliary grinding bodies before the separating device. This effect is opposed by the described measures. The comminution effect intensifies as the grinding process progresses during the flow of the grinding stock through the grinding chamber.

Further features, advantages and details of the invention will become apparent from the ensuing description of an exemplary embodiment, taken in conjunction with the drawing.

DESCRIPTION OF THE PREFERRED EMBODIMENT

Figure 1:
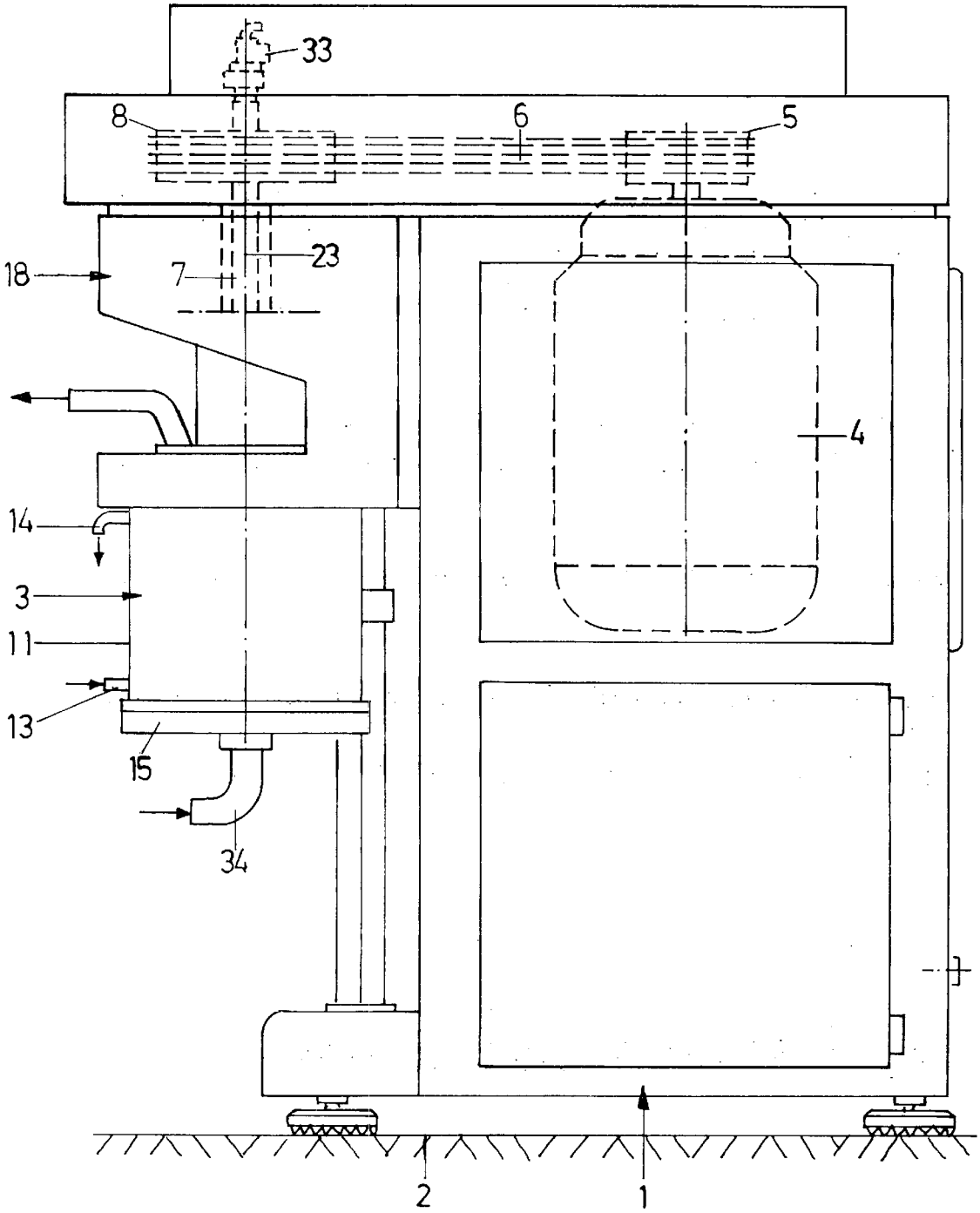
FIG. 1 is a diagrammatic illustration of a side view of an agitator mill.

The agitator mill seen in FIG. 1 customarily comprises a stand 1 which supports itself on the ground 2 and to which is fixable a cylindrical grinding receptacle 3 of vertical arrangement. An electric driving motor 4 lodges in the stand 1; it is equipped with a V-belt pulley 5, by which a V-belt pulley 8, which is non-rotatably joined to a driving shaft 7, is drivable in high-speed rotation.

Figure 2:
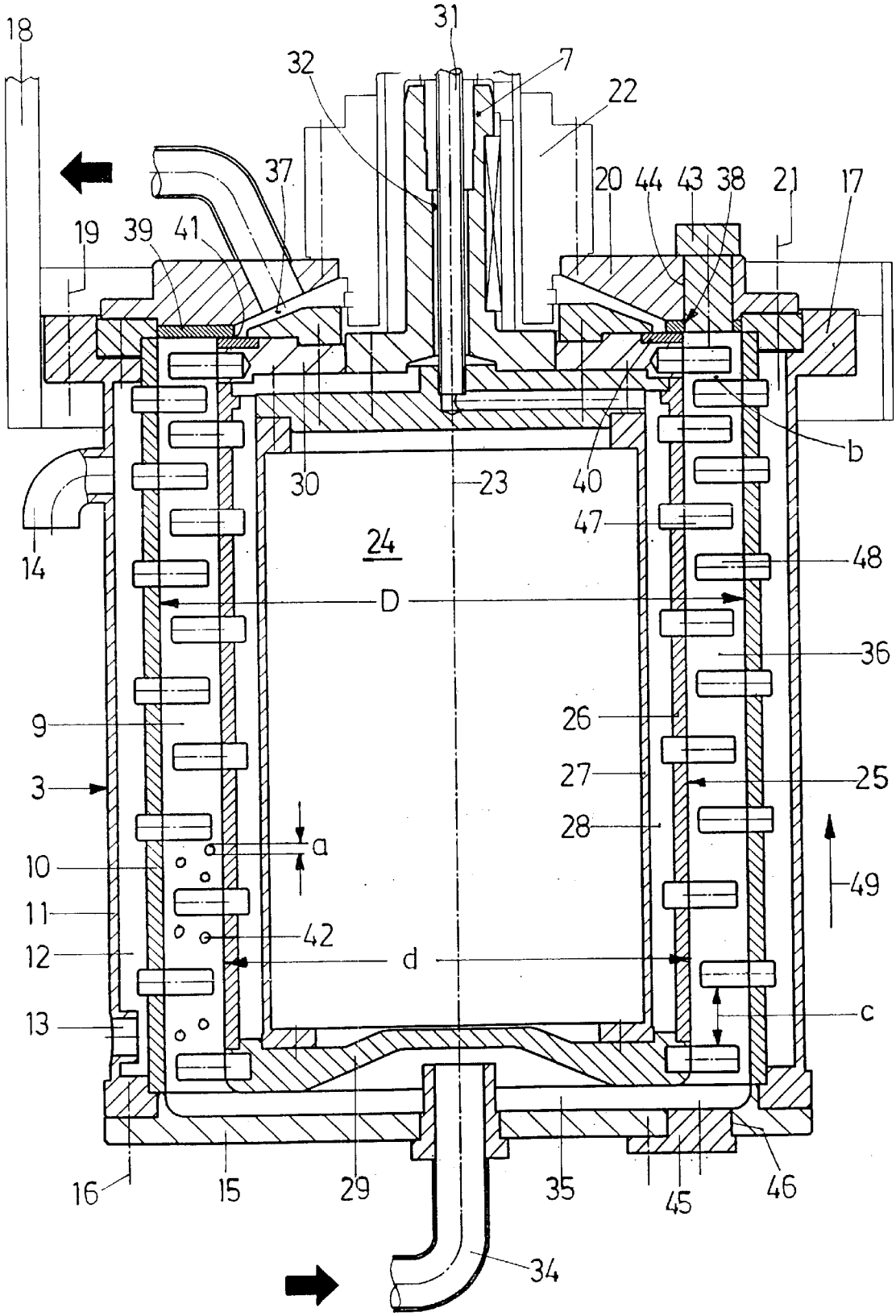
FIG. 2 is a longitudinal section through the grinding receptacle of the agitator mill.

As seen in particular in FIG. 2, the grinding receptacle 3 comprises a cylindrical inner wall 10 which envelops a grinding chamber 9 and which is enveloped by a substantially cylindrical outer jacket 11. Between them, the inner cylinder 10 and the outer jacket 11 define a cooling chamber 12 which is connected to a coolant inlet 13 and a coolant outlet 14. Downwards the grinding chamber 9 is finished by a circular bottom plate 15 which is mounted on the grinding receptacle 3 by means of screws 16 (roughly outlined).

The grinding receptacle 3 has an upper annular flange 17, by means of which it is mounted on the underside of a carrying housing 18 via screws 19 (also roughly outlined); this carrying housing 18 is mounted on the stand 1 of the agitator mill. The grinding chamber 9 is closed by means of a cover 20 which is secured by means of screws 21 (also roughly outlined).

The carrying housing 18 comprises a central bearing and sealing housing 22 which is disposed coaxially of the vertical central longitudinal axis 23 of the grinding receptacle 3. The driving shaft 7, which equally extends coaxially of the axis 23 and on which is mounted an agitator unit 24, passes through this bearing and sealing housing 22.

The agitator unit 24 has a cylindrical rotor 25 which comprises a cylindrical outer wall 26 and a inner wall 27 which is disposed coaxially thereof; between them, the walls 26 and 27 define an annular cylindrical cooling jacket 28. On its lower side that faces away from the driving shaft 7, the rotor 25 is closed by a rotor bottom 29 which also finishes the cooling jacket 28 downwardly. On its upper side that is adjacent to the shaft 7, the rotor 25 is closed by a rotor cover 30, on which also the shaft 7 is mounted.

Through a coolant supply pipe 31, coolant is supplied to the cooling jacket 28. Coolant discharge takes place through an annular coolant discharge channel 32 which is formed between the shaft 7 and the supply pipe 31. For the supply and discharge of coolant, a rotating joint 33 is attached to the upper end of the driving shaft 7.

In the vicinity of the axis 23, the rotor bottom 29 is bulged concavely into the rotor 25. This is where a grinding stock inlet 34—coaxially of the axis 23—opens into the lower grinding stock supply area 35, substantially in the shape of an annular disk, of the grinding chamber 9. Between the inner wall 10 and the outer wall 26, the grinding chamber 9 comprises an annular cylindrical grinding area 36 in which the grinding process takes place substantially. A grinding stock outlet 37 leads from this grinding area 36 through the cover 20 of the grinding receptacle 3. Disposed between the grinding area 36 and the grinding stock outlet 37 is an auxiliary-grinding-body separating device 38, which is a so-called annular separating gap. It comprises a stationary annular disk 39 which is mounted on the cover 20 and an annular disk 40 which is mounted on the rotor cover 30, rotating together with the rotor 25, these two annular disks 39, 40 defining, between them, a separating gap 41 which connects the grinding area 36 with the grinding stock outlet 37 and which, in a manner known per se, has a width that corresponds maximally to half the diameter a of the auxiliary grinding bodies 42 available in the grinding chamber 9. An auxiliary-grinding-body feed opening 44 is formed in the cover 20 and can be closed by means of a plug 43. An auxiliary-grinding-body evacuation opening 46 is formed in the bottom plate 15 and can also be closed by a plug 45. As for the ratio that the diameter D of the inner wall 10 bears to the diameter d of the rotor, $d \geqq 0.5$ D applies.

The outer wall 26 of the rotor 25 is equipped with annular cylindrical, pin or rod-shaped agitator elements 47 which project therefrom radially towards the inner wall 10. Several agitator elements 47 are disposed on the periphery of the rotor 25 in a radial plane relative to the axis 23 i.e., in a horizontal plane; in the direction of the axis 23, agitator elements 47 are disposed in several radial planes. Mounted on the inner wall 10 of the grinding receptacle 3 are counterpart elements 48 of the same kind as the agitator elements 47, which likewise project towards the rotor 25 and are disposed in radial planes i.e., horizontal planes, with the counterpart elements 48 of a radial plane being centered between the neighboring agitator elements 47 in the neighboring radial planes. The rod-shaped agitator elements 47 and the counterpart elements 48 overlap considerably in the radial direction. Fundamentally, the agitator elements and the counterpart elements may have any shape available in practice.

As seen in FIG. 2, the axial distance of the agitator elements 47 one the one hand and thus also that of the counterpart elements 48 on the other hand decreases in the grinding area 36 in the flow direction 49 i.e., from the grinding-stock supply area 35 towards the auxiliary-grinding-body separating device 38. The smallest distance b in the flow direction 49 and in the direction of the axis 23, respectively, of the last agitator elements 47 disposed in a horizontal radial plane before the separating device 38, from the last adjacent counterpart elements 48 is not smaller than three times the diameter a of the auxiliary grinding bodies 42 used. Consequently $b \geqq 3a$ applies. The greatest distance c of the lowermost agitator elements 47, which adjoin the grinding-stock supply area 35, from the equally lowermost i.e., neighboring, counterpart elements 48 should be at least 1.5 times greater than b. In this regard $c \geqq 1.5b$ applies. $c \leqq 3b$ should apply to a practically oriented ratio. For clarification, the distances are exaggerated in FIG. 2. As regards the diameter a of the auxiliary grinding bodies 42, 0.1 mm$\leqq a \leqq$6 mm applies. In particular in the case of an annular separating gap 38, 0.5 mm$\leqq a$ applies preferably. In particular within this range of diameter, the auxiliary grinding bodies 42 of a filling of a grinding chamber 9 have substantially the same diameter.

The decrease in distance from c to b can be continuous—as seen in FIG. 2. However, the annular cylindrical grinding area 36 may also be divided into three subsequent zones by the agitator elements 47 and the counterpart elements 48 having the same distance c from each other in the lowermost section that adjoins the grinding-stock supply area 35. In the third section that adjoins the separating device 38, they also have the same distance b which corresponds to the shortest or smallest distance. In the middle section, they have a mean distance that ranges between the greatest distance c and the smallest distance b. As seen in FIG. 2, the described distances b and c are illustrated as the clear distance of an agitator element 47 from an axially adjacent counterpart element 48.

High-speed actuation of the agitator unit 24 takes place by means of the driving motor 4 so that the auxiliary grinding bodies 42 are subject to intense acceleration pulses from the agitator elements 47. The auxiliary grinding bodies are braked by the counterpart elements 48 so that intense motions take place of the auxiliary grinding bodies 42 relative to each other and relative to the individual grinding-stock particles. This results in intense grinding and dispersing effects. Reducing the distance of the agitator elements 47 from the counterpart elements 48 towards the separating device 38 i.e., towards the grinding-stock outlet 37, helps obtain higher local shear intensity, and thus higher power density, as the distance decreases from c to b. The auxiliary grinding bodies 42 tend to avoid the status of higher power density, consequently they migrate to the area of lower power density i.e., to the area of greater distances c of the agitator elements 47 from the adjacent counterpart elements 48. This effect is of special importance when very tough i.e., very viscous, grinding stock is ground. The grinding i.e., the comminution, of the grinding-stock particles causes their surface to grow, related to their mass. As a result, the toughness of the grinding stock increases in the flow direction 49 from the grinding-stock supply area 35 to the grinding-stock outlet 37. Owing to the growing viscosity, increasingly higher entrainment forces occur in the flow direction 49, the result of which would actually be an accumulation of auxiliary grinding bodies 42 before the separating device 38. This effect is opposed by the described effects that are produced by the modification of the distance of the agitator elements 47 from the counterpart elements 48; this effect is compensated.

What is claimed is:

1. An agitator mill comprising a grinding receptacle (3), which has
a cylindrical wall (10),
a bottom (15), and
a cover (20);

a grinding chamber (9) formed in the grinding receptacle (3);

an agitator unit (24), which has
a driving shaft (7), which is disposed substantially outside the grinding chamber (9) and drivable in rotation, and
a rotor (25), which is located in the grinding chamber (9) and connected to the driving shaft (7);

agitator elements (47), with a length, mounted on the rotor (25),
which are disposed in radial planes radially of the central longitudinal axis (23), and
which project into the grinding chamber (9) radially of the central longitudinal axis (23) towards the wall (10) of the grinding receptacle (3);

counterpart elements (48), with a length, mounted on the wall (10) of the grinding receptacle (3),
which are disposed in radial planes radially of the central longitudinal axis (23), and
which project towards the rotor (25) into the grinding chamber (9);

a grinding-stock inlet (34), which leads through the bottom (15) into the grinding chamber (9);

an auxiliary-grinding-body separating device (38) disposed in the vicinity of the cover (20) and
which is disposed upstream of a grinding-stock outlet (37); and a filling of auxiliary grinding bodies (42), with a diameter a, in the grinding chamber (9);

wherein the distance from each other of agitator elements (47) and adjacent counterpart elements (48) in the direction of the central longitudinal axis (23) decreases from a greatest distance c in the vicinity of the grinding-stock inlet (34) to a smallest distance b in the vicinity of the auxiliary-grinding-body separating device (38).

2. An agitator mill according to claim 1, wherein the distance of agitator elements (47) from counterpart elements (48), which adjoin each other in the direction of the central longitudinal axis (23), decreases steadily from the area of the grinding-stock inlet (34) as far as to the auxiliary-grinding-body separating device (38).

3. An agitator mill according to claim 1, wherein the distance of agitator elements (47) and counterpart elements (48), which adjoin each other in the direction of the central longitudinal axis (23), decreases by sections from the grinding-stock inlet (34) as far as to the auxiliary-grinding-body separating device (38).

4. An agitator mill according to claim 1, wherein $c \leqq 3b$ applies to the ratio that the greatest distance c of agitator elements (47) from counterpart elements (48) bears to the smallest distance b of agitator elements (47) from counterpart elements (48).

5. An agitator mill according to claim 1, wherein $c \geqq 1.5b$ applies to the ratio that the greatest distance c of agitator elements (47) from counterpart elements (48) bears to the smallest distance b of agitator elements (47) from counterpart elements (48).

6. An agitator mill according to claim 1, wherein $b \geqq 3a$ applies to the ratio that the smallest distance b of agitator elements (47) from counterpart elements (48) bears to a greatest diameter a of the auxiliary grinding bodies (42).

7. An agitator mill according to claim 1, wherein $0.1\ \text{mm} \leqq a \leqq 6\ \text{mm}$ applies to the diameter a of the auxiliary grinding bodies (42).

8. An agitator mill according to claim 7, wherein $0.5\ \text{mm} \leqq a$ applies to the diameter a of the auxiliary grinding bodies (42).

9. An agitator mill according to claim 1, wherein the auxiliary grinding bodies (42) of a filling of the grinding chamber (9) have substantially the same diameter a.

10. An agitator mill according to claim 9, wherein the auxiliary grinding bodies (42) of a filling of the grinding chamber (9) have substantially the same diameter a.

11. An agitator mill according to claim 1, wherein the agitator elements (47) and the counterpart elements (48) are cylindrical rods.

12. An agitator mill according to claim 11, wherein the agitator elements (47) and the counterpart elements (48) overlap each other radially of the central longitudinal axis (23).

13. An agitator mill according to claim 1, wherein the agitator elements (47) and the counterpart elements (48) have the same length.

14. An agitator mill according to claim 13, wherein the agitator elements (47) and the counterpart elements (48) overlap each other radially of the central longitudinal axis (23).

15. An agitator mill according to claim 1, wherein the number of the agitator elements (47) and of the counterpart elements (48) is the same in all the radial planes.

16. An agitator mill according to claim 1, wherein the number of at least one of the agitator elements (47) and the counterpart elements (48) in the individual radial planes increases from the grinding-stock inlet (34) towards the auxiliary-grinding-body separating device (38).

* * * * *